US011779109B2

(12) United States Patent
Schwartz

(10) Patent No.: US 11,779,109 B2
(45) Date of Patent: Oct. 10, 2023

(54) APPARATUS AND METHOD FOR CREATING A BARRIER

(71) Applicant: PUCKSRUS, INC., Sarasota, FL (US)

(72) Inventor: Steven Schwartz, Sarasota, FL (US)

(73) Assignee: PUCKSRUS, INC., Sarasota, FL (US)

( * ) Notice: Subject to any disclaimer, the term of this patent is extended or adjusted under 35 U.S.C. 154(b) by 0 days.

(21) Appl. No.: 17/865,432

(22) Filed: Jul. 15, 2022

(65) Prior Publication Data

US 2022/0346548 A1 Nov. 3, 2022

Related U.S. Application Data

(63) Continuation of application No. 17/008,831, filed on Sep. 1, 2020, now Pat. No. 11,445,818.

(51) Int. Cl.
*A47B 41/06* (2006.01)
*A47B 83/00* (2006.01)

(52) U.S. Cl.
CPC ..... *A47B 41/06* (2013.01); *A47B 83/001* (2013.01)

(58) Field of Classification Search
CPC ..... A47B 97/00; A47B 2200/12; A47B 41/06; A47B 83/001
USPC ..... 312/196
See application file for complete search history.

(56) References Cited

U.S. PATENT DOCUMENTS

| | | | | |
|---|---|---|---|---|
| 2,240,729 | A * | 5/1941 | Von Palmenberg | A47F 3/005 16/390 |
| 3,629,960 | A * | 12/1971 | Roush | A47B 41/06 434/432 |
| 5,890,782 | A * | 4/1999 | Alberts | A47B 17/00 312/258 |
| 7,036,438 | B2 * | 5/2006 | Okamoto | A47B 17/02 108/50.01 |
| 11,160,376 | B2 * | 11/2021 | Gass | A47B 97/00 |
| 2008/0211361 | A1 * | 9/2008 | Boxenbaum | A47B 83/001 312/196 |

* cited by examiner

*Primary Examiner* — Matthew W Ing
(74) *Attorney, Agent, or Firm* — Gearhart Law, LLC; David Postolski

(57) ABSTRACT

A barrier system is described herein. The barrier system includes at least three floating barrier elements, at least four securement components, and at least four stabilizing components. The at least four securement components are configured to secure the first floating barrier element between the second floating barrier element and the third floating barrier element to form a barrier. The at least four stabilizing components are configured to stabilize the barrier. The components of the barrier system are interchangeable and movable.

9 Claims, 27 Drawing Sheets

104

APPARATUS AND METHOD FOR CREATING A BARRIER

CROSS-REFERENCE TO RELATED APPLICATIONS SECTION

This application is a U.S. Non-Provisional patent application that claims priority to and is a continuation application of U.S. Non-Provisional patent application Ser. No. 17/008,831 filed on Sep. 1, 2020, the entire contents of which are hereby incorporated by reference in their entirety.

FIELD OF THE EMBODIMENTS

The field of the invention and its embodiments relate to a barrier system. In particular, the field of the invention and its embodiments relate to a barrier system that includes at least three floating barrier elements, at least four securement components configured to secure the first floating barrier element between the second floating barrier element and the third floating barrier element to form a barrier, and at least four stabilizing components configured to stabilize the barrier. The components of the barrier system are interchangeable and movable.

BACKGROUND OF THE EMBODIMENTS

Coronavirus (or COVID-19) unexpectedly swept the world in 2019, leaving many businesses, offices, and classrooms scrambling for protective solutions for employees, customers, and students. Some fashioned temporary solutions, while others created permanent solutions, such as make-shift barriers from foam, glass, or plexi-glass, among other materials. However, such solutions prove difficult to construct and fail to provide full protection to the employees, customers, and students from airborne diseases. Other solutions are unappealing and diminish a look or feel of a business or organization. Thus, what is needed is a safe, secure, simple, cost-effective, and professional barrier system. Further, what is needed is a portable unified containment kit for use in lobby areas, in reception areas, on conference tables, on community tables, on cafeteria tables, on employee desks, in break rooms, and/or as cubicle extensions to protect from airborne diseases.

Some barrier systems exist in the art. However, their means of operation are substantially different from the present disclosure, as the other inventions fail to solve all the problems taught by the present disclosure.

SUMMARY OF THE EMBODIMENTS

The present invention and its embodiments relate to a barrier system. In particular, the field of the invention and its embodiments relate to a barrier system that includes at least three floating barrier elements, at least four securement components configured to secure the first floating barrier element between the second floating barrier element and the third floating barrier element to form a barrier, and at least four stabilizing components configured to stabilize the barrier. The components of the barrier system are interchangeable and movable.

A first embodiment of the present invention describes a barrier system. The barrier system includes at least three floating barrier elements, at least four securement components, and at least four stabilizing components. Each of the at least three floating barrier elements comprise: a first surface disposed opposite a second surface, a first side disposed opposite a second side, and a third side disposed opposite a fourth side. A first floating barrier element of the at least three floating barrier elements is affixed between a second floating barrier element of the at least three floating barrier elements and a third floating barrier element of the at least three floating barrier elements such that the third side of the first floating barrier element is perpendicular to the first surface of the second floating barrier element and the fourth side of the first floating barrier element is perpendicular to the first surface of the third floating barrier element.

In an example, a quantity of the at least three floating barrier elements is five. A second floating barrier element, a third floating barrier element, a fourth floating barrier element, and a fifth floating barrier element of the at least three floating barrier elements share a shape and a size. A shape and the size of the second floating barrier element, the third floating barrier element, the fourth floating barrier element, and the fifth floating barrier element differ from the shape and the size of the first floating barrier element of the at least three floating barrier elements.

The at least four securement components are configured to secure the first floating barrier element between the second floating barrier element and the third floating barrier element to form a barrier. Each of the at least four securement components comprises: a body disposed between a first planar side and a second side, the second side comprising at least two receiving components extending away from the second side. Each of the at least two receiving components comprise two parallel components forming a channel therebetween. A portion of at least one of the two parallel components comprises an opening configured to receive a fastening component therethrough. In some examples, the body of each of the at least four securement components further comprises: another opening spanning a width of the body and configured to receive another fastening component therethrough.

In an example, a first securement component of the at least four securement components is affixed to a portion of the first side of the first floating barrier element and to a portion of the first side of the second floating barrier element and a second securement component of the at least four securement components secures another portion of the first side of the first floating barrier element to a portion of the first side of the third floating barrier element. In another example, a third securement component of the at least four securement components secures a portion of the second side of the first floating barrier element to a portion of the second side of the second floating barrier element and a fourth securement component of the at least four securement components secures another portion of the second side of the first floating barrier element to a portion of the second side of the third floating barrier element.

In further examples, a first receiving component of the at least two receiving components is perpendicular to at least a second receiving component of the at least two receiving components. Further, the channel of the first receiving component fails to intersect with the channel of the second receiving component. In other examples, a second receiving component of the at least two receiving components and a third receiving component of the at least two receiving components are at an angle in relation to the first receiving component of the at least two receiving components.

In additional examples, a quantity of the at least two receiving components is three. A first receiving component of the at least two receiving components spans a length of the second side. In another example, a second receiving component of the at least two receiving components and a third receiving component of the at least two receiving components are perpendicular to the receiving component of the at least two receiving components. A channel of the first receiving component fails to intersect with a channel of the second receiving component or the channel of the third receiving component.

The at least four stabilizing components are configured to stabilize the barrier. Each of the at least four stabilizing components comprises: a cylindrical body having a first side disposed opposite a second side. The first side is planar and is configured to contact a horizontal surface. The cylindrical body includes an opening disposed therethrough and configured to receive a fastening component therein and a capture region extending to the second side. The capture region is configured to receive a portion of a barrier element of at least three floating barrier elements therein. In other examples, the capture region comprises a slit having two parallel walls, each of the two parallel walls comprising a protrusion extending from the slit towards an outer surface of the cylindrical body.

A second embodiment of the present invention describes a method to create a barrier. The method includes: placing a first floating barrier element between at least a second floating barrier element and a third floating barrier element, securing the first floating barrier element to the second floating barrier element via at least two securement components, securing the first floating barrier element to the third floating barrier element via at least two securement components to form a barrier, and utilizing at least four stabilizing components to stabilize the barrier. In examples, the first floating barrier element is perpendicular to the second floating barrier element and is perpendicular to the third floating barrier element. The method may further include: placing a first floating barrier element between a fourth floating barrier element and a fifth floating barrier element, wherein the second floating barrier element, the third floating barrier element, the fourth floating barrier element, and the fifth floating barrier element are positioned at an angle relative to the first floating barrier element. The angle is an acute angle.

A third embodiment of the present invention describes a portable barrier containment system. The portable barrier containment system includes at least three floating barrier elements, at least four securement components, and at least four stabilizing components. Each of the at least three floating barrier elements comprise: a first surface disposed opposite a second surface, a first side disposed opposite a second side, and a third side disposed opposite a fourth side. A first floating barrier element of the at least three floating barrier elements is affixed between a second floating barrier element of the at least three floating barrier elements and a third floating barrier element of the at least three floating barrier elements such that the third side of the first floating barrier element is perpendicular to the first surface of the second floating barrier element and the fourth side of the first floating barrier element is perpendicular to the first surface of the third floating barrier element.

The at least four securement components are configured to secure the first floating barrier element between the second floating barrier element and the third floating barrier element to form a barrier. Each of the at least four securement components comprises: a body disposed between a first planar side and a second side. The second side includes at least two receiving components extending away from the second side. Each of the at least two receiving components comprise two parallel components forming a channel therebetween. A portion of at least one of the two parallel components comprise an opening configured to receive a fastening component therethrough. The body also includes at least one opening spanning a width of the body from the first planar side to the second side.

A first securement component of the at least four securement components is affixed to a portion of the first side of the first floating barrier element and to a portion of the first side of the second floating barrier element. A second securement component of the at least four securement components secures another portion of the first side of the first floating barrier element to a portion of the first side of the third floating barrier element. A third securement component of the at least four securement components secures a portion of the second side of the first floating barrier element to a portion of the second side of the second floating barrier element. A fourth securement component of the at least four securement components secures another portion of the second side of the first floating barrier element to a portion of the second side of the third floating barrier element.

The at least four stabilizing components are configured to stabilize the barrier. Each of the at least four stabilizing components comprises: a cylindrical body having a first side disposed opposite a second side. The first side is planar and is configured to contact a horizontal surface. The cylindrical body comprises an opening disposed therethrough and configured to receive a fastening component therein and a capture region extending to the second side. The capture region is configured to receive a portion of a barrier element of at least three floating barrier elements therein. The capture region comprises a slit having two parallel walls, where each of the two parallel walls comprise a protrusion extending from the slit towards an outer surface of the cylindrical body.

In general, the present invention succeeds in conferring the following benefits and objectives.

It is an object of the present invention to provide a barrier system.

It is an object of the present invention to provide a simple, cost-effective, and professional barrier system.

It is an object of the present invention to provide a portable unified containment kit, or a shield system.

It is an object of the present invention to provide portable unified containment kit for use in lobby areas, in reception areas, on conference tables, on community tables, on cafeteria tables, on employee desks, in break rooms, and/or as cubicle extensions.

It is an object of the present invention to provide a barrier system that includes at least three floating barrier elements, at least four securement components configured to secure the first floating barrier element between the second floating barrier element and the third floating barrier element to form a barrier, and at least four stabilizing components configured to stabilize the barrier.

It is an object of the present invention to provide a barrier system having components that are interchangeable and movable.

It is an object of the present invention to provide a portable barrier containment system.

DESCRIPTION OF THE PREFERRED EMBODIMENTS

Figure 1A:
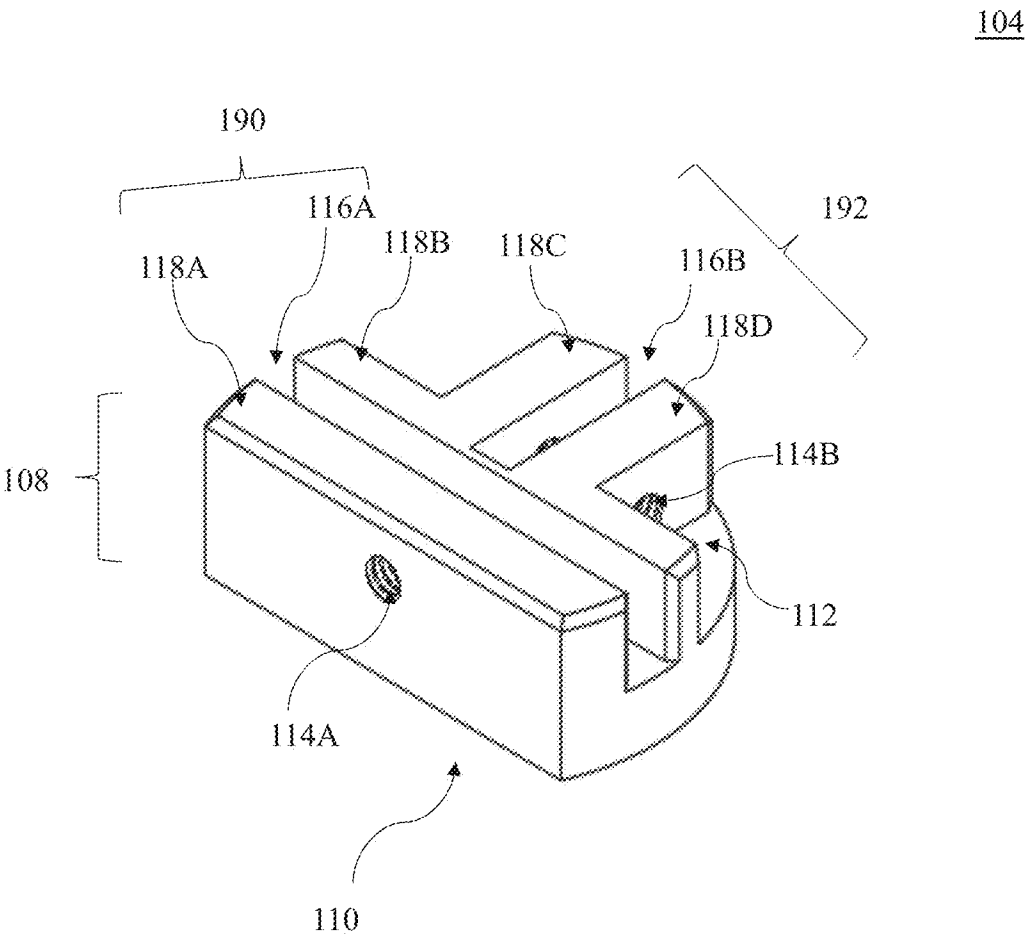
FIG. 1A depicts a schematic diagram of a first embodiment of a securement component for use within a barrier system, according to at least some embodiments disclosed herein.
Figure 1B:
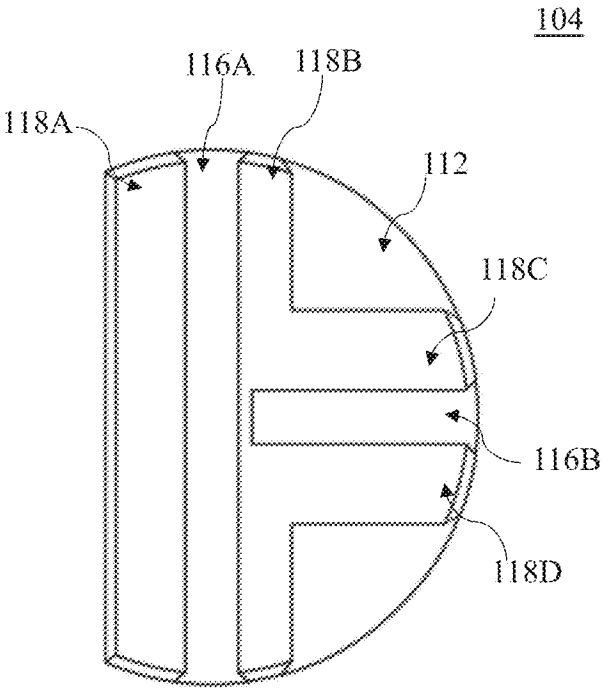
FIG. 1B depicts a top plan view of a schematic diagram of a first embodiment of a securement component for use within a barrier system, according to at least some embodiments disclosed herein.
Figure 1C:
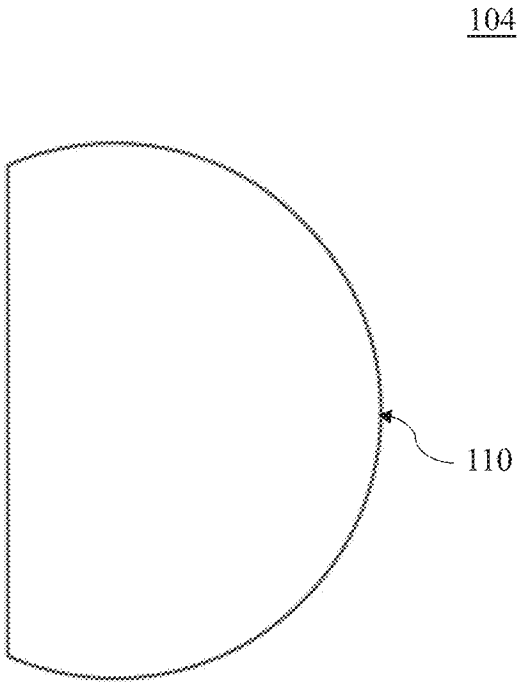
FIG. 1C depicts a bottom view of a schematic diagram of a first embodiment of a securement component for use within a barrier system, according to at least some embodiments disclosed herein.
Figure 1D:
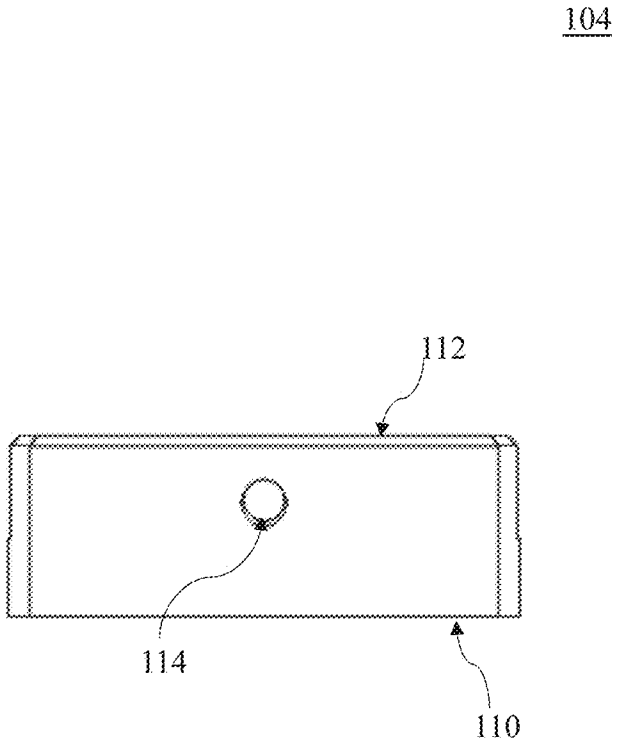
FIG. 1D depicts a side view of a schematic diagram of a first embodiment of a securement component for use within a barrier system, according to at least some embodiments disclosed herein.

The preferred embodiments of the present invention will now be described with reference to the drawings. Identical elements in the various figures are identified with the same reference numerals. Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

A barrier system 100 is described herein and is depicted in FIG. 8-FIG. 15. The barrier system 100 is a portable unified containment kit, or a shield system that may be used in lobby areas, in reception areas, in classroom settings, on conference tables, on community tables, on cafeteria tables, on employee desks, in break rooms, and/or as cubicle extensions to protect employees, customers, and/or students, among others, from COVID-19 and/or other airborne diseases.

The barrier system 100 includes: at least three floating barrier elements 134, 136, and 138, at least four securement components 104A, 104B, 104C, and 104D, and at least four stabilizing components 106A, 106B, 106C, and 106D. The components of the barrier system 100 are engineered to be adaptable to hundreds of configurations. Moreover, the components of the barrier system 100 are easy to assemble and disassemble, using a locking mechanism. The barrier system 100 is expandable and fits smaller 24 inch to larger 84 inch face panels.

A quantity of the floating barrier elements 134, 136, and 138, the securement components 104A, 104B, 104C, and 104D, and the stabilizing components 106A, 106B, 106C, and 106D are not limited to the examples described herein. It should be appreciated that, in an illustrative example, each of the at least four securement components 104A, 104B, 104C, and 104D has a width of 2½ inches and a height of ⅞ of an inch. In another illustrative example, each of the at least four stabilizing components 106A, 106B, 106C, and 106D has a width of 1 inch and a height of ⅞ of an inch. In some examples, each of the at least four stabilizing components 106A, 106B, 106C, and 106D are 1 inch round. However, a size of each of the at least four securement components 104A, 104B, 104C, and 104D and a size of each of the at least four stabilizing components 106A, 106B, 106C, and 106D may be increased or decreased depending on the needs of the user.

It should further be appreciated that each of the at least four stabilizing components 106A, 106B, 106C, and 106D may be used to cover any exposed glass/plastic material on any corner of a securement component of the at least four securement components 104A, 104B, 104C, and 104D. As such, the system allows for no exposure of any edges or corners of the at least four securement components 104A, 104B, 104C, and 104D.

A first embodiment of each of the at least four securement components 104A, 104B, 104C, and 104D is depicted in FIG. 1A-FIG. 1D and is a "top puck." Each of the at least four securement components 104A, 104B, 104C, and 104D of the first embodiment include a body 108 disposed between a first planar side 110 (e.g., a bottom side) and a second side 112 (e.g., a top side). The body 108 is semi-circular in shape. However, the shape of the body 108 is not limited to such. In some examples, the first planar side 110 may be configured to contact a horizontal surface 140 (of FIG. 9-FIG. 15). In an illustrative example, the barrier system 100 may allow for an exchange of documents between the first planar side 110 and the horizontal surface 140 of up to ⅜ of an inch thick.

The second side 112 of the body 108 includes at least two receiving components (e.g., a first receiving component 190 and a second receiving component 192) extending away from the second side 112. The first receiving component 190 is configured perpendicular to the second receiving component 192. As depicted in FIG. 1A, the first receiving component 190 includes two parallel components 118A, 118B spanning a length of the second side 112 of the body 108 and forming a first channel 116A therebetween. The second receiving component 192 also includes two parallel components 118C, 118D spanning a portion of the second side 112 of the body 108 and forming a second channel 116B therebetween. A portion of at least one of the two parallel components 118A, 118B and/or the two parallel components 118C, 118D comprise one or more openings 114A, 114B spanning a width of the portion of at least one of the two parallel components 118A, 118B and/or the two parallel components 118C, 118D. The one or more openings 114A, 114B are configured to receive a fastening component 142 therethrough. It should be appreciated that the fastening component 142 may be a screw, a bolt, etc. and is not limited to any particular components.

Moreover, in some examples, a width of each of the two parallel components 118A, 118B and the two parallel components 118C, 118D are identical. In other examples, the width of each of the two parallel components 118A, 118B are identical and the width of each of the two parallel components 118C, 118D are identical.

Figure 2A:
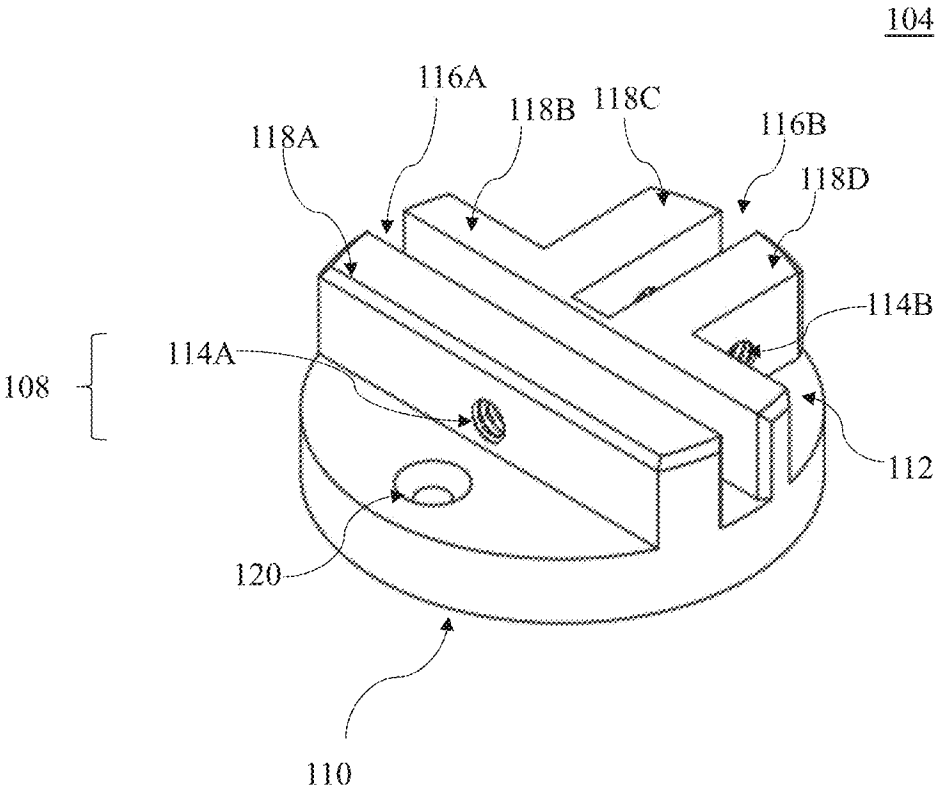
FIG. 2A depicts a schematic diagram of a second embodiment of a securement component for use within a barrier system, according to at least some embodiments disclosed herein.
Figure 2B:
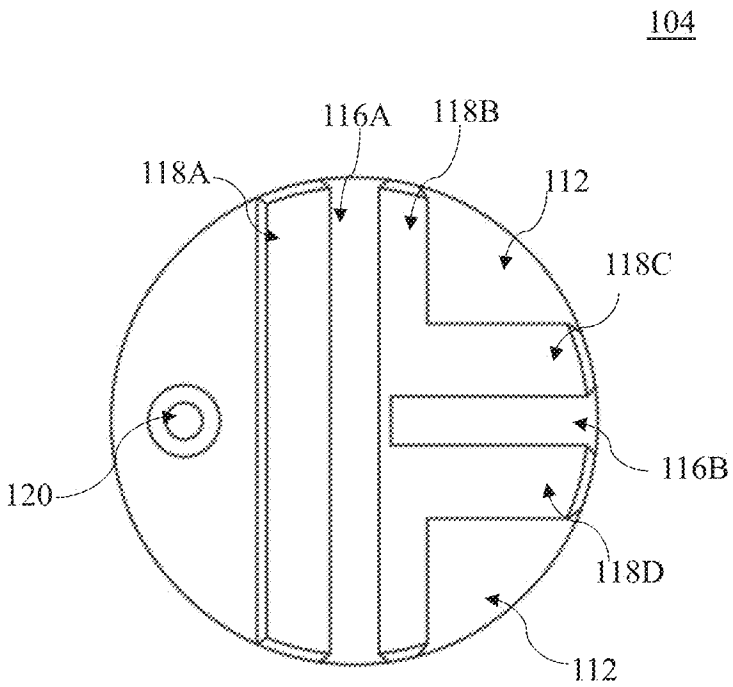
FIG. 2B depicts a top plan view of a schematic diagram of a second embodiment of a securement component for use within a barrier system, according to at least some embodiments disclosed herein.
Figure 2C:
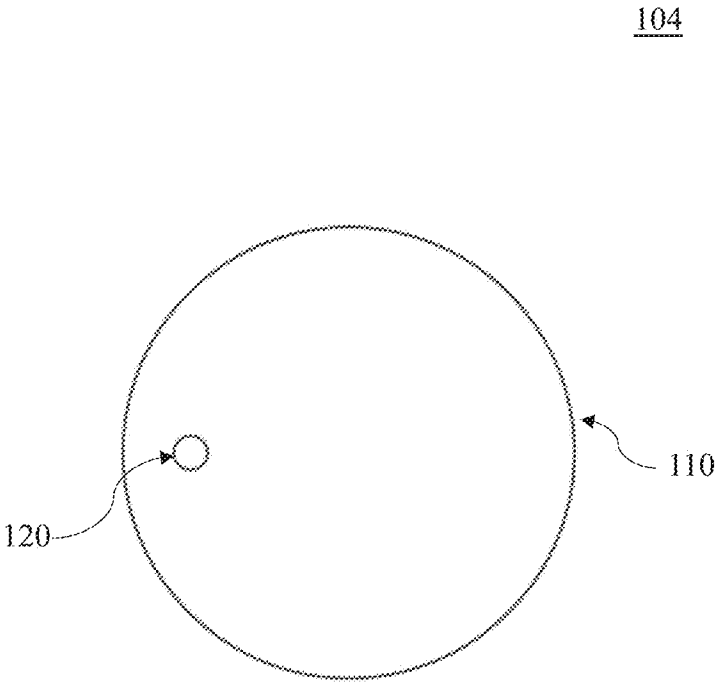
FIG. 2C depicts a bottom view of a schematic diagram of a second embodiment of a securement component for use within a barrier system, according to at least some embodiments disclosed herein.

A second embodiment of each of the at least four securement components 104A, 104B, 104C, and 104D is depicted in FIG. 2A-FIG. 2C and is a "base puck." The second embodiment of each of the at least four securement components 104A, 104B, 104C, and 104D is substantially similar to the first embodiment. However, the body 108 of the second embodiment of each of the at least four securement components 104A, 104B, 104C, and 104D is circular in shape. Moreover, the body 108 of the second embodiment of each of the at least four securement components 104A, 104B, 104C, and 104D comprises another opening 120 spanning a width of the body 108. The other opening 120 is configured to receive the fastening component 142 therein.

Figure 3A:
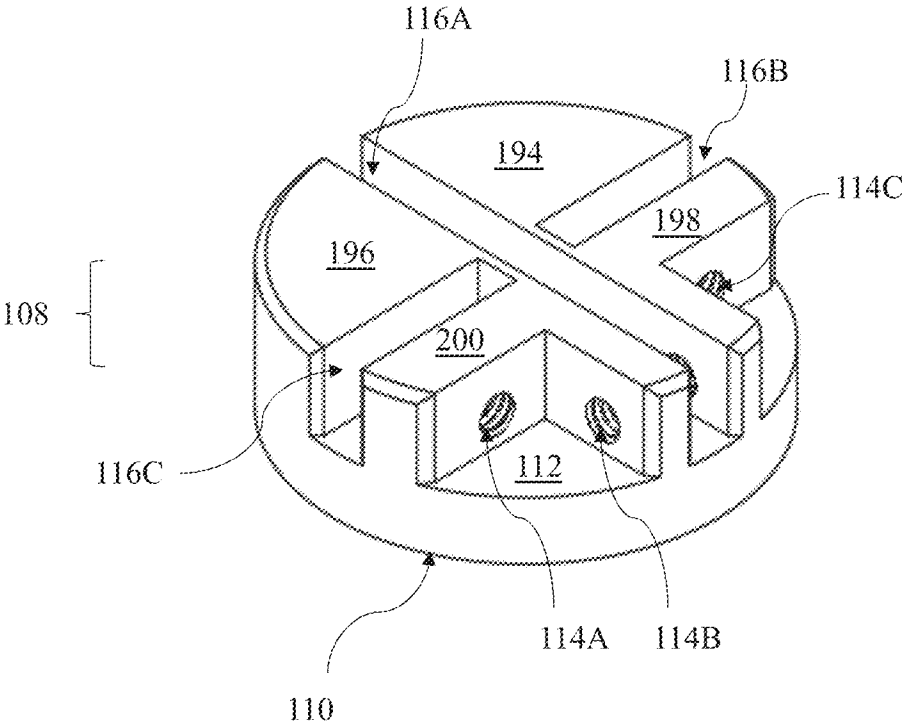
FIG. 3A depicts a schematic diagram of a third embodiment of a securement component for use within a barrier system, according to at least some embodiments disclosed herein.
Figure 3B:
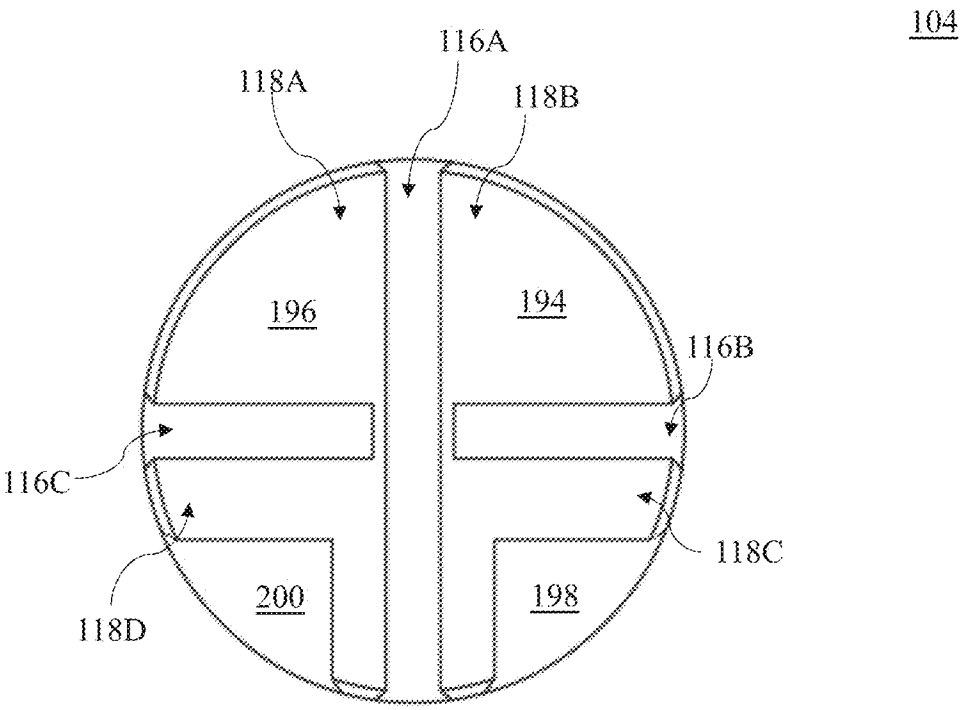
FIG. 3B depicts a top plan view of a schematic diagram of a third embodiment of a securement component for use within a barrier system, according to at least some embodiments disclosed herein.

A third embodiment of each of the at least four securement components 104A, 104B, 104C, and 104D is depicted in FIG. 3A and FIG. 3B and is an "in-line and return adaptor puck." The third embodiment of each of the at least four securement components 104A, 104B, 104C, and 104D is substantially similar to the second embodiment described supra. However, the third embodiment of each of the at least four securement components 104A, 104B, 104C, and 104D includes the first channel 116A, the second channel 116B, and a third channel 116C. The first channel 116A spans an entire length of the second side 112 of the body 108. The second channel 116B and the third channel 116C are each perpendicular to the first channel 116A, but do not intersect with the first channel 116A.

The third embodiment of each of the at least four securement components 104A, 104B, 104C, and 104D additionally includes a first portion 194 located between the first channel 116A and the second channel 116B and extending away from the second side 112 of the body 108. The third embodiment also includes a second portion 196 located between the first channel 116A and the third channel 116C and extending away from the second side 112 of the body 108. The third embodiment of each of the at least four securement components 104A, 104B, 104C, and 104D further includes a third portion 198 located between the second channel 116B and the second side 112 of the body 108 and a fourth portion 200 located between the third channel 116C and the second 112 of the body 108.

Figure 4A:
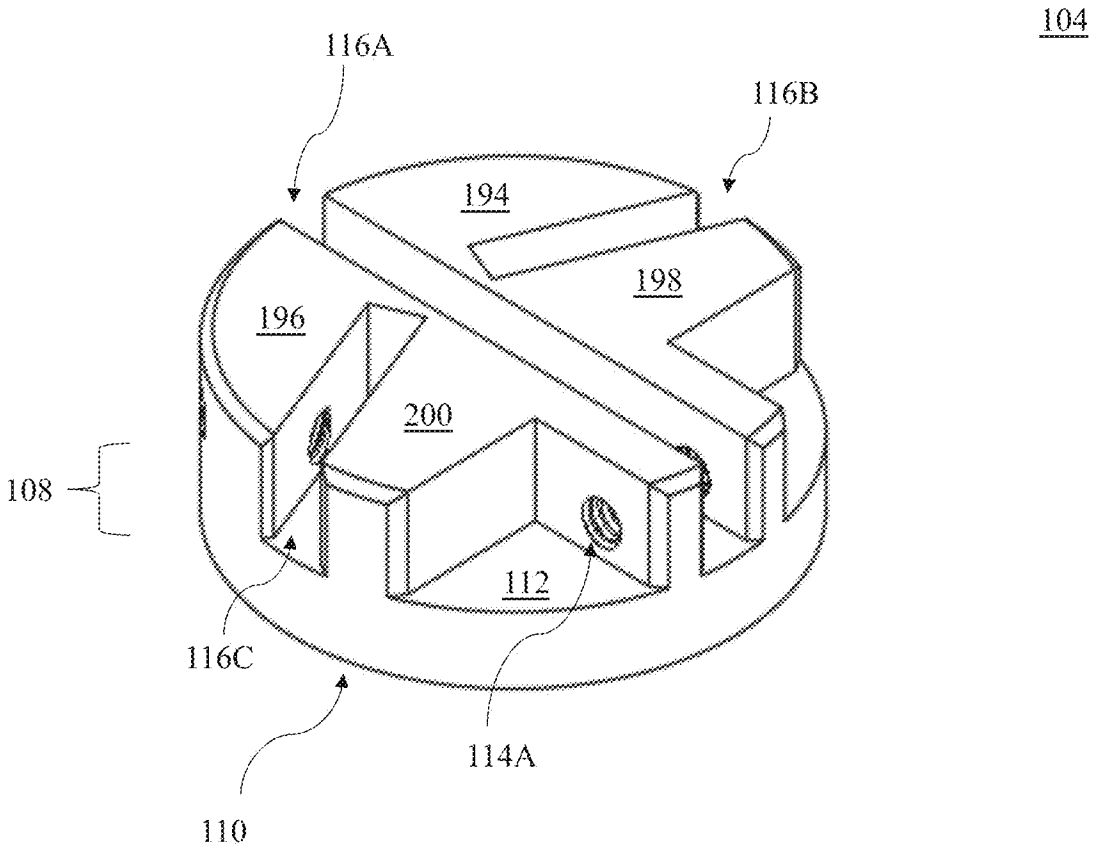
FIG. 4A depicts a schematic diagram of a fourth embodiment of a securement component for use within a barrier system, according to at least some embodiments disclosed herein.
Figure 4B:
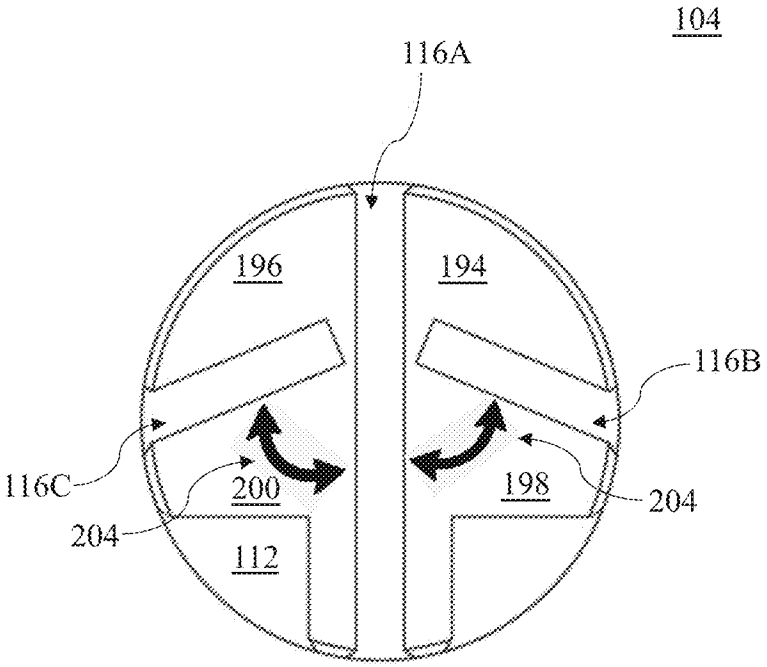
FIG. 4B depicts a top plan view of a schematic diagram of a fourth embodiment of a securement component for use within a barrier system, according to at least some embodiments disclosed herein.

A fourth embodiment of each of the at least four securement components 104A, 104B, 104C, and 104D is depicted in FIG. 4A and FIG. 4B and is an "angular adaptor puck." The fourth embodiment is substantially similar to the third embodiment described herein. However, in the fourth embodiment, the second channel 116B and the third channel 116C are at an angle in relation to the first channel 116A, such that each of the second channel 116B and the third channel 116C form an acute angle 204 in relation to the first channel 116A. In examples, the acute angle 204 is a 45 degree angle. However, such acute angle 204 is not limited to such.

Figure 5A:
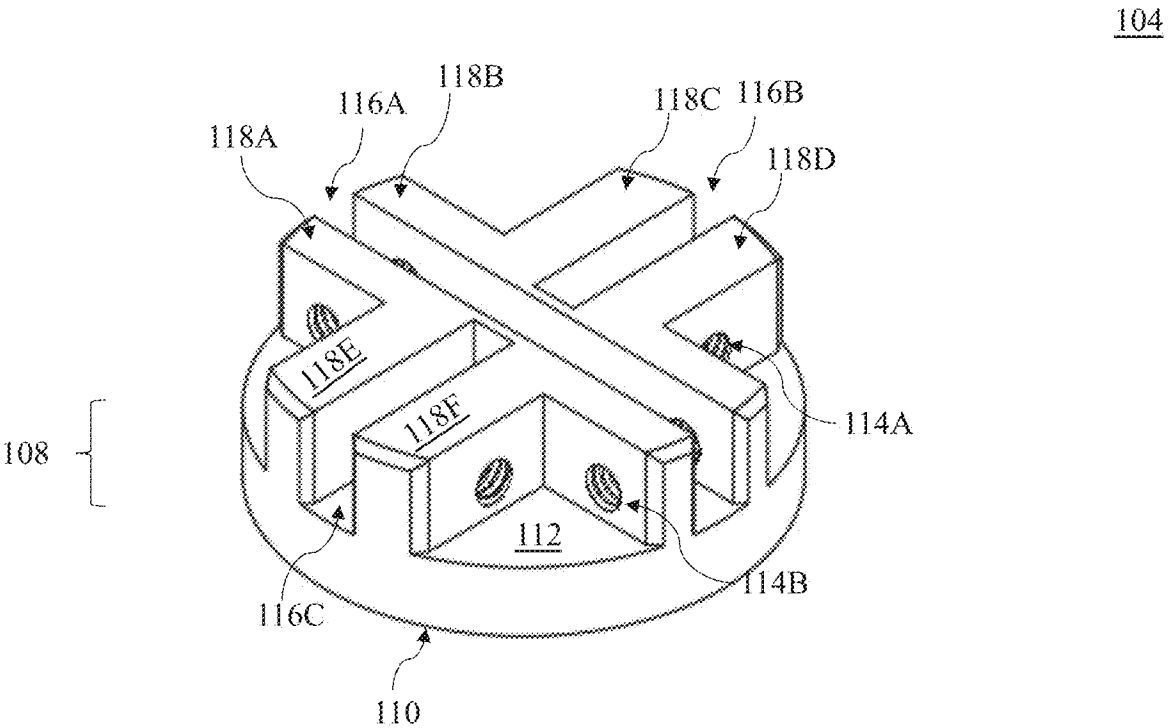
FIG. 5A depicts a schematic diagram of a fifth embodiment of a securement component for use within a barrier system, according to at least some embodiments disclosed herein.
Figure 5B:
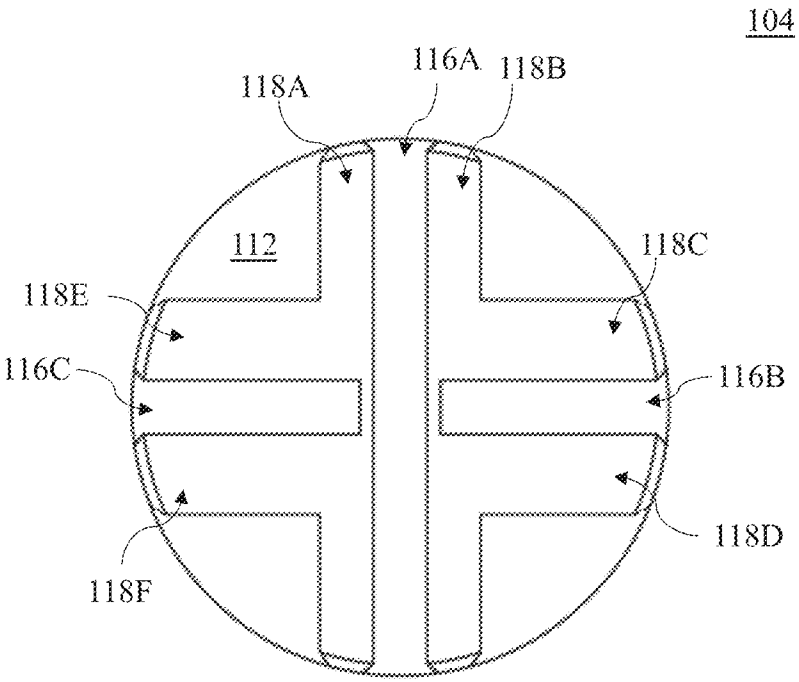
FIG. 5B depicts a top plan view of a schematic diagram of a fifth embodiment of a securement component for use within a barrier system, according to at least some embodiments disclosed herein.

A fifth embodiment of each of the at least four securement components 104A, 104B, 104C, and 104D is depicted in FIG. 5A and FIG. 5B and is a "top puck." The fifth embodiment is substantially similar to other embodiments described herein. However, the fifth embodiment includes two parallel components 118A, 118B spanning a length of the second side 112 of the body 108 and forming a first channel 116A therebetween. Furthermore, the fifth embodiment includes two parallel components 118C, 118D that are perpendicular to the two parallel components 118A, 118B, forming a second channel 116B therebetween and two parallel components 118E, 118F that that are perpendicular to the two parallel components 118A, 118B, forming a third channel 116C therebetween. Each of the second channel 116B and the third channel 116C do not intersect the first channel 116A.

Figure 6A:
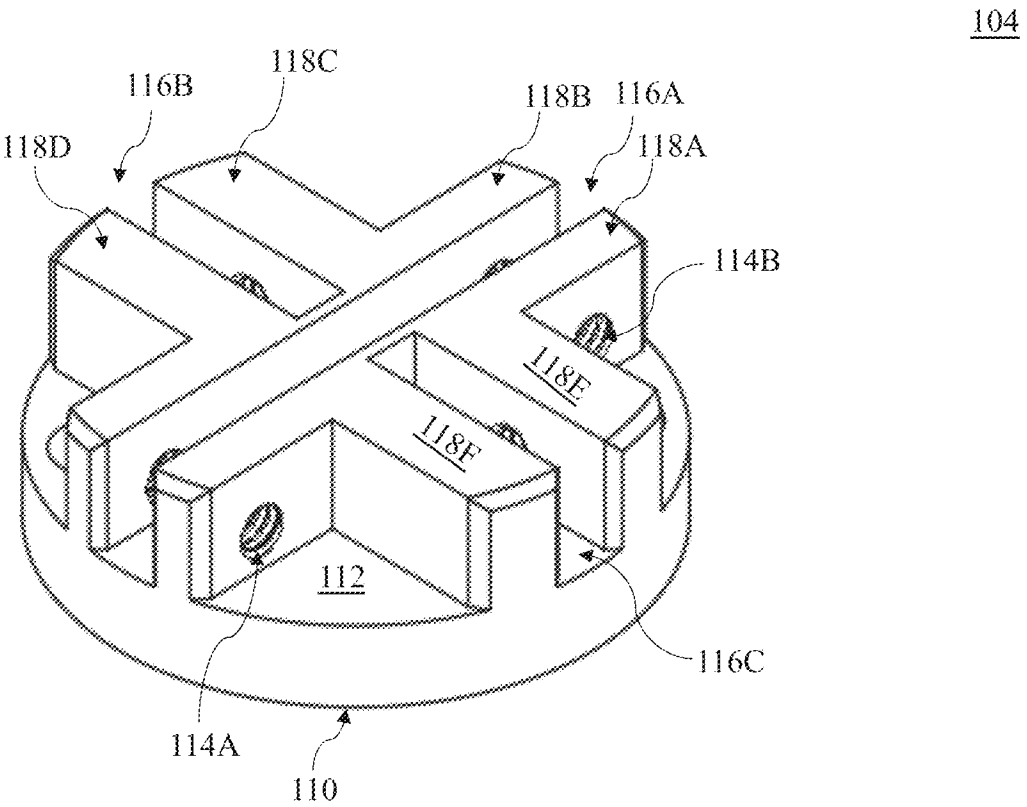
FIG. 6A depicts a schematic diagram of a sixth embodiment of a securement component for use within a barrier system, according to at least some embodiments disclosed herein.
Figure 6B:
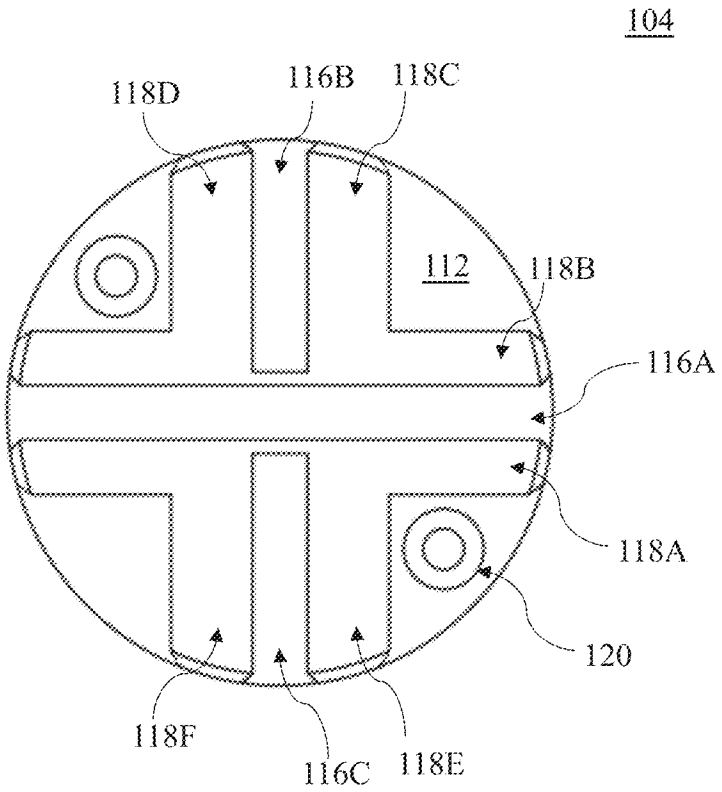
FIG. 6B depicts a top plan view of a schematic diagram of a sixth embodiment of a securement component for use within a barrier system, according to at least some embodiments disclosed herein.
Figure 6C:
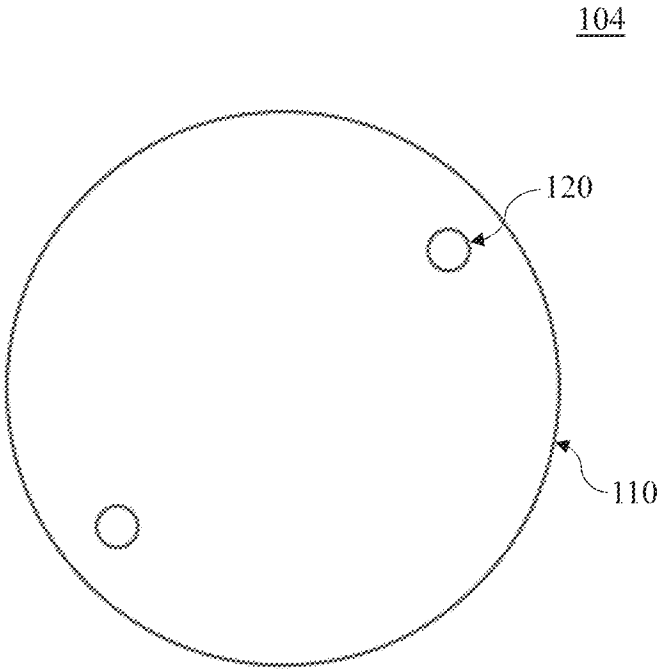
FIG. 6C depicts a bottom view of a schematic diagram of a sixth embodiment of a securement component for use within a barrier system, according to at least some embodiments disclosed herein.

A sixth embodiment of each of the at least four securement components 104A, 104B, 104C, and 104D is depicted in FIG. 6A, FIG. 6B, and FIG. 6C and is a "base puck." The sixth embodiment is substantially similar to the fifth embodiment. However, the body 108 of the sixth embodiment includes the other opening 120 spanning a width of the body 108 (also found in the second embodiment). The other opening 120 is configured to receive the fastening component 142 therein.

Figure 7A:
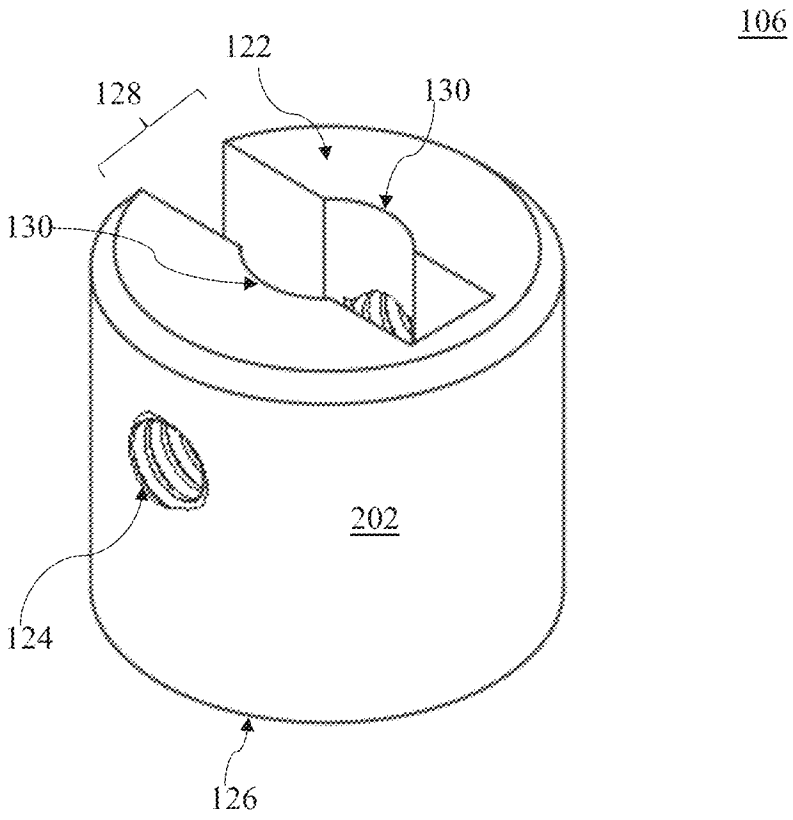
FIG. 7A depicts a schematic diagram of a stabilizing component for use within a barrier system, according to at least some embodiments disclosed herein.
Figure 7B:
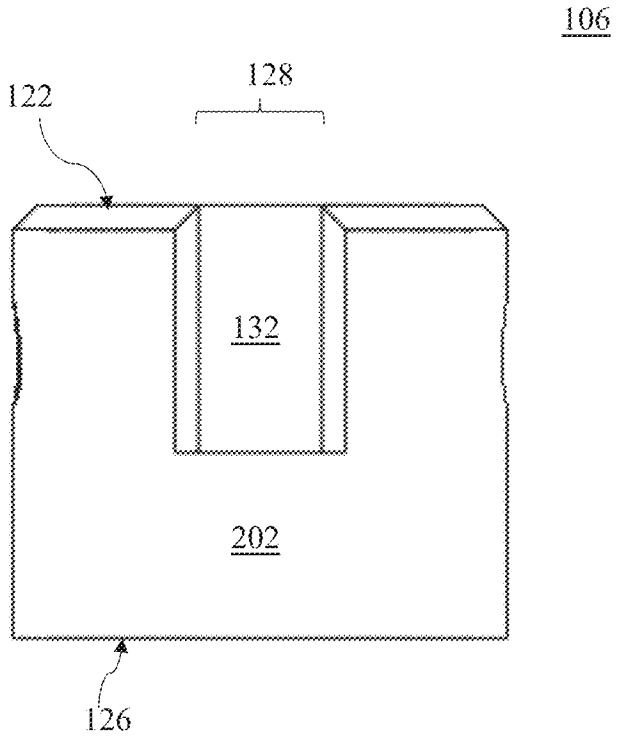
FIG. 7B depicts a side view of a schematic diagram of a stabilizing component for use within a barrier system, according to at least some embodiments disclosed herein.
Figure 7C:
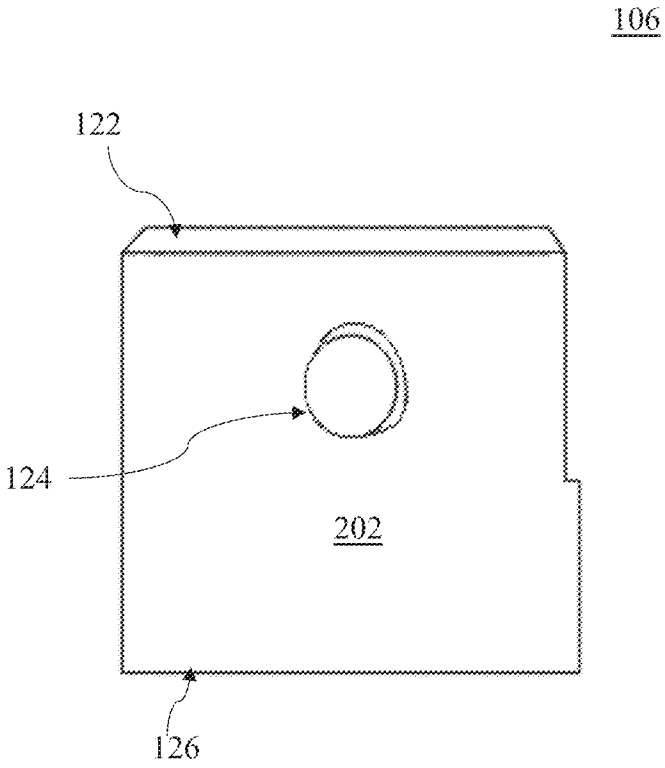
FIG. 7C depicts another side view of a schematic diagram of a stabilizing component for use within a barrier system, according to at least some embodiments disclosed herein.

The at least four stabilizing components 106A, 106B, 106C, and 106D ("panel feet") are depicted in FIG. 7A, FIG. 7B, and FIG. 7C and are configured to stabilize the barrier. The at least four stabilizing components 106A, 106B, 106C, and 106D include a cylindrical body 202 having a first side 126 disposed opposite a second side 122. The first side 126 is planar and is configured to contact a horizontal surface 140.

The cylindrical body 202 includes an opening 124 disposed therethrough that is configured to receive the fastening component 142 therein. The cylindrical body 202 also includes a capture region 128. The capture region 128 begins at or near a center of the cylindrical body 202 and extends to the second side 122. The capture region 128 is configured to receive a portion of a barrier element of the at least three floating barrier elements 134, 136, and 138 therein. More specifically, the capture region 128 comprises a slit having two parallel walls, where each of the two parallel walls comprise a protrusion 130 extending from the slit towards an outer surface of the cylindrical body 202.

Figure 8:
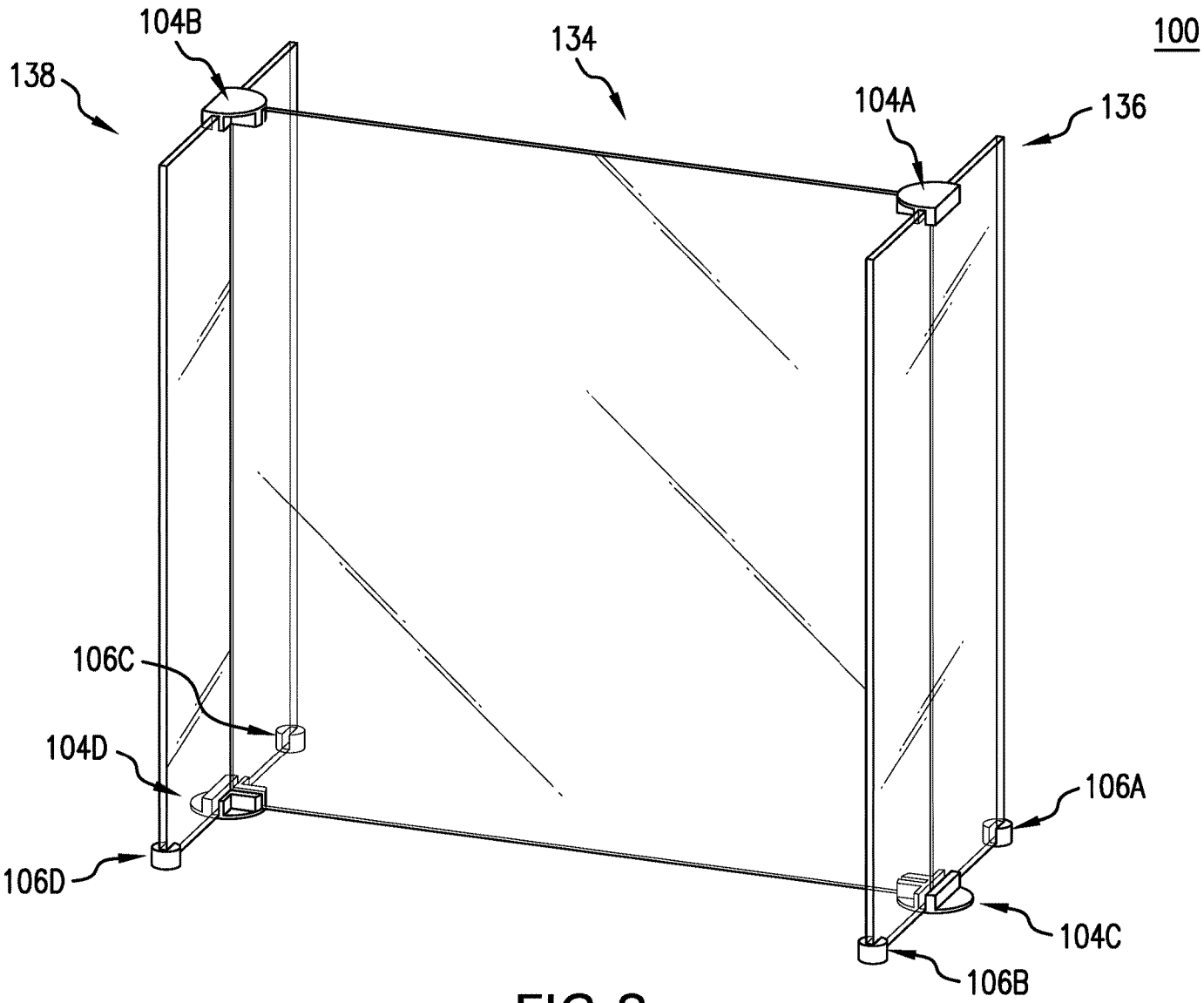
FIG. 8 depicts a schematic diagram of a first embodiment of a barrier system, according to at least some embodiments disclosed herein.
Figure 9:
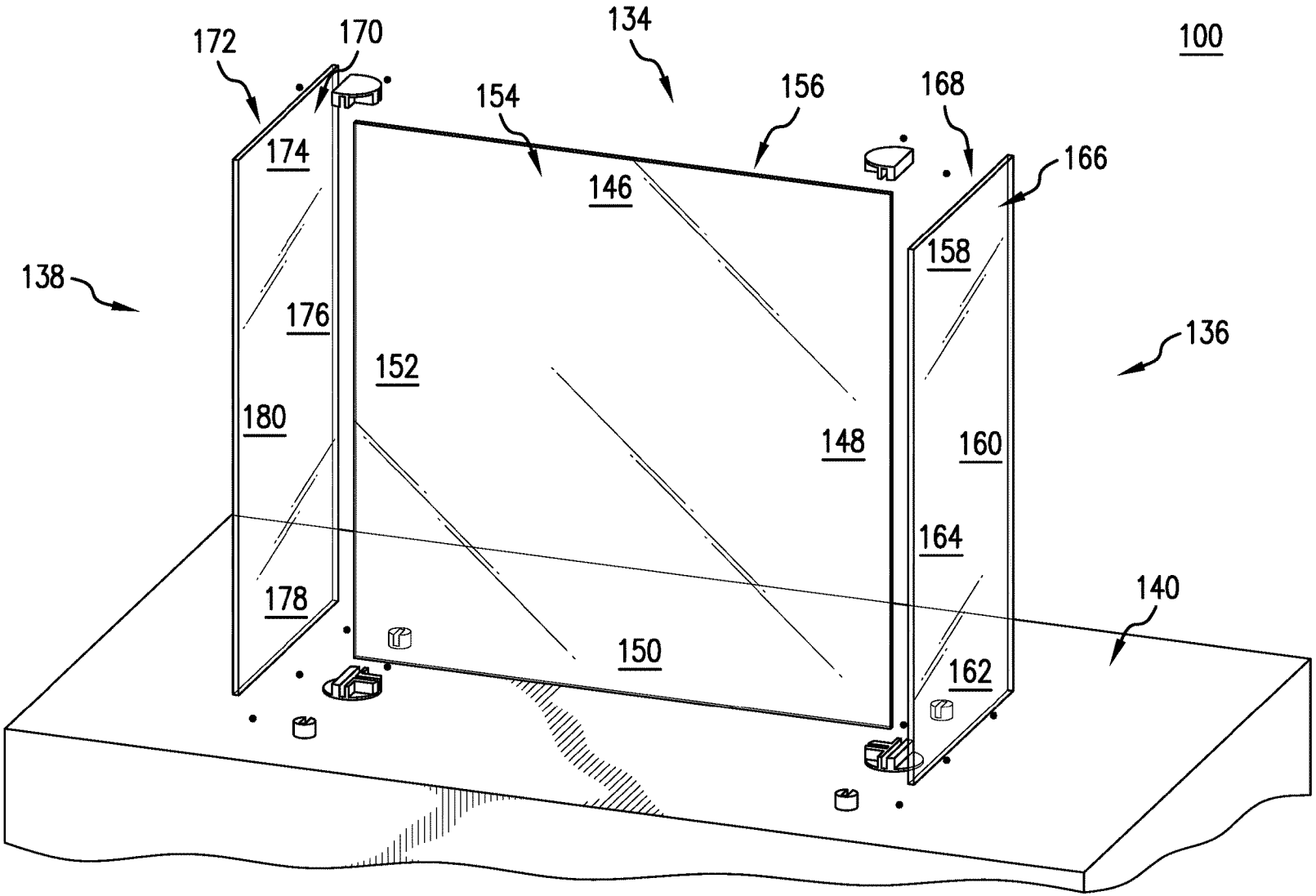
FIG. 9 depicts another schematic diagram of a first embodiment of a barrier system, according to at least some embodiments disclosed herein.
Figure 10:
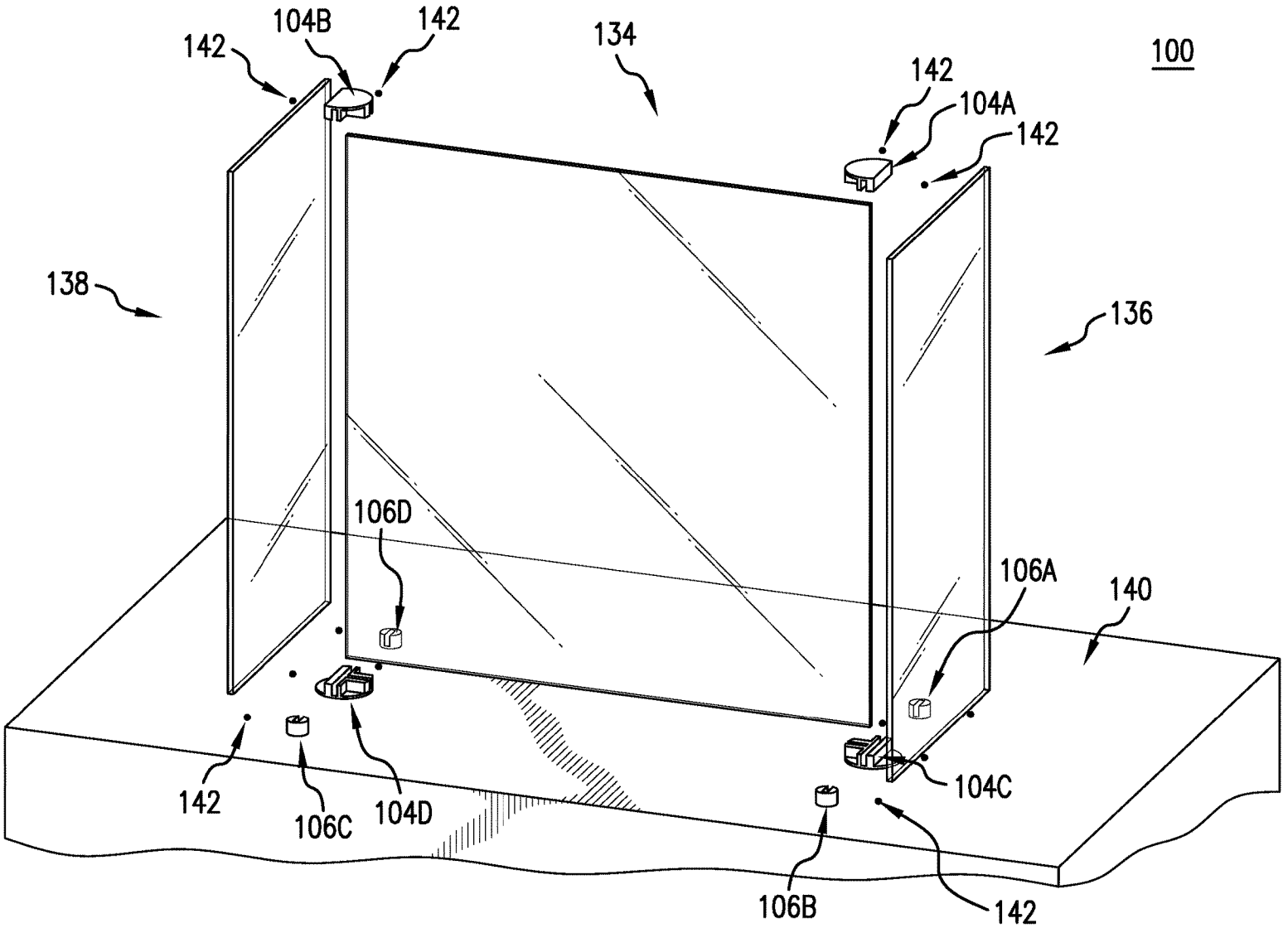
FIG. 10 depicts another schematic diagram of a first embodiment of a barrier system, according to at least some embodiments disclosed herein.

A first embodiment of the barrier system 100 is depicted in FIG. 8, FIG. 9, and FIG. 10. The first embodiment of the barrier system 100 includes a first floating barrier element 134, a second floating barrier element 136, and a third floating barrier element 138. Each of the first floating barrier element 134, the second floating barrier element 136, and the third floating barrier element 138 include a first surface disposed opposite a second surface, a first side disposed opposite a second side, and a third side disposed opposite a fourth side. More specifically, the first floating barrier element 134 includes the first surface 154 disposed opposite the second surface 156, the first side 146 disposed opposite the second side 150 (the second side 150 being configured to contact the horizontal surface 140), and the third side 148 disposed opposite the fourth side 152. The second floating barrier element 136 includes the first surface 168 disposed opposite the second surface 166, the first side 158 disposed opposite the second side 162 (the second side 162 being configured to contact the horizontal surface 140), and the third side 164 disposed opposite the fourth side 160. The third floating barrier element 138 includes the first surface 170 disposed opposite the second surface 172, the first side 174 disposed opposite the second side 178 (the second side 178 being configured to contact the horizontal surface 140), and the third side 180 disposed opposite the fourth side 176.

As depicted, the floating barrier element 134 is disposed between the second floating barrier element 136 and the third floating barrier element 138 such that the second floating barrier element 136 is perpendicular to the first floating barrier element 134 and the third floating barrier element 138 is perpendicular to the first floating barrier element 134. More particularly, the third side 148 of the first floating barrier element 134 is perpendicular to the first surface 168 of the second floating barrier element 136. The fourth side 152 of the first floating barrier element 134 is perpendicular to the first surface 170 of the third floating barrier element 138.

Moreover, as depicted, the first securement component 104A is affixed to a portion of the first side 146 of the first floating barrier element 134 and to a portion of the first side 158 of the second floating barrier element 136. Also, a second securement component 104B secures another portion of the first side 146 of the first floating barrier element 134 to a portion of the first side 174 of the third floating barrier element 138. A third securement component 104C secures a portion of the second side 150 of the first floating barrier element 134 to a portion of the second side 162 of the second floating barrier element 136. A fourth securement component 104D secures another portion of the second side 150 of the first floating barrier element 134 to a portion of the second side 178 of the third floating barrier element 138.

The first embodiment of the barrier system 100, as depicted in FIG. 8, FIG. 9, and FIG. 10, may be formed by placing the first floating barrier element 134 between the second floating barrier element 136 and the third floating barrier element 138, securing the first floating barrier element 134 to the second floating barrier element 136 via at least two securement components (e.g., the first securement component 104A and the third securement component 104C), securing the first floating barrier element 134 to the third floating barrier element 138 via at least two securement components (e.g., the second securement component 104B and the fourth securement component 104D) to form the barrier system 100, and utilizing at least four stabilizing components 106A, 106B, 106C, and 106D to stabilize the system 100. Moreover, one or more fastening components 142 may be used with the securement components and/or the stabilizing components to ensure structural stability of the barrier system 100.

Figure 11:
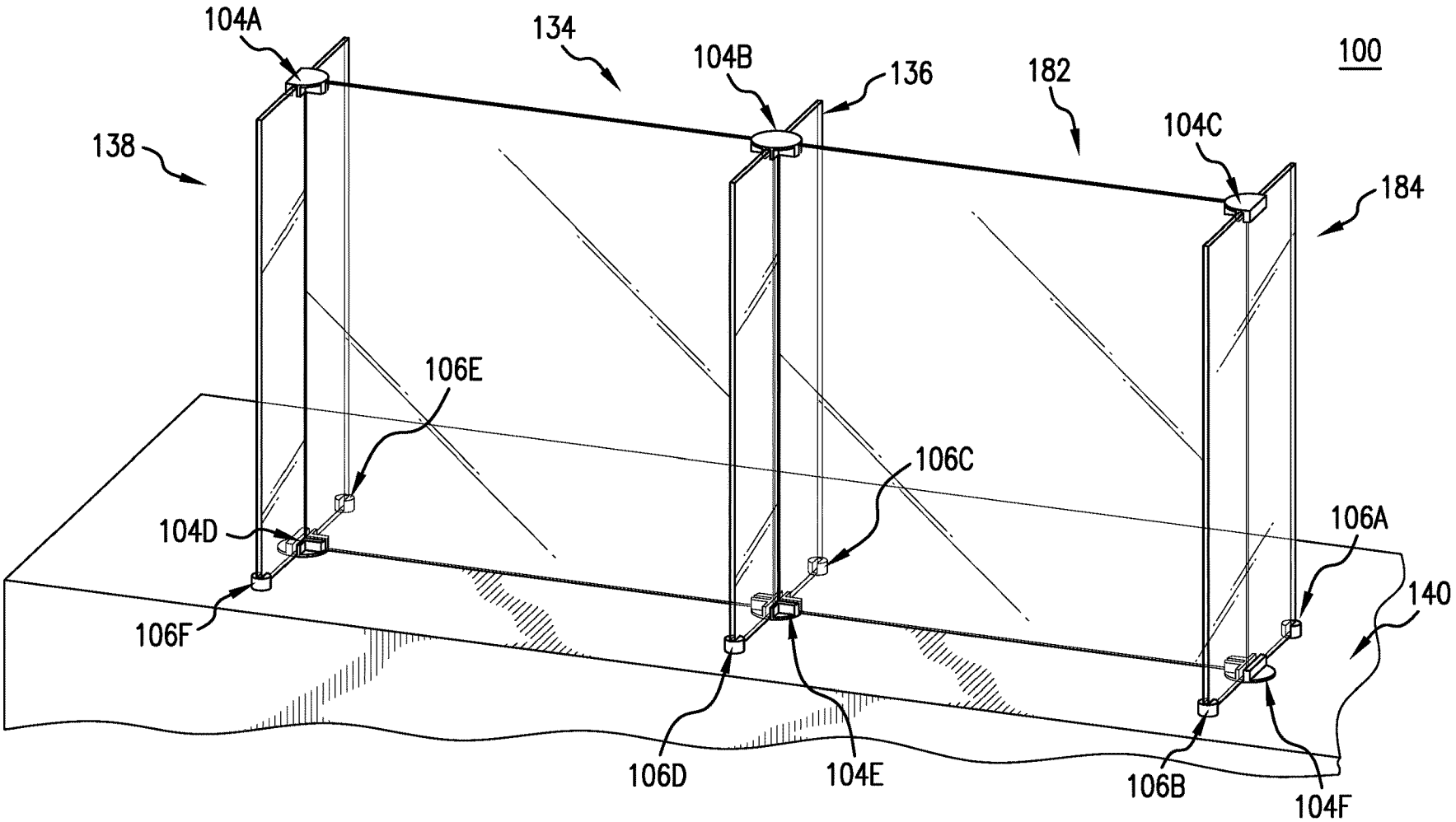
FIG. 11 depicts a schematic diagram of a second embodiment of a barrier system, according to at least some embodiments disclosed herein.

A second embodiment of the barrier system 100 is depicted in FIG. 11. The second embodiment of the barrier system 100 is substantially similar to the first embodiment of the barrier system 100 described herein. However, the second embodiment of the barrier system 100 additionally includes a fourth floating barrier element 182 and a fifth floating barrier element 184. The fourth floating barrier element 182 is affixed between the second floating barrier element 136 and the fifth floating barrier element 184. More particularly, the second floating barrier element 136 is perpendicular to both the first floating barrier element 134 and the fourth floating barrier element 182. The fifth floating barrier element 184 is perpendicular to the fourth floating barrier element 182.

Figure 12:
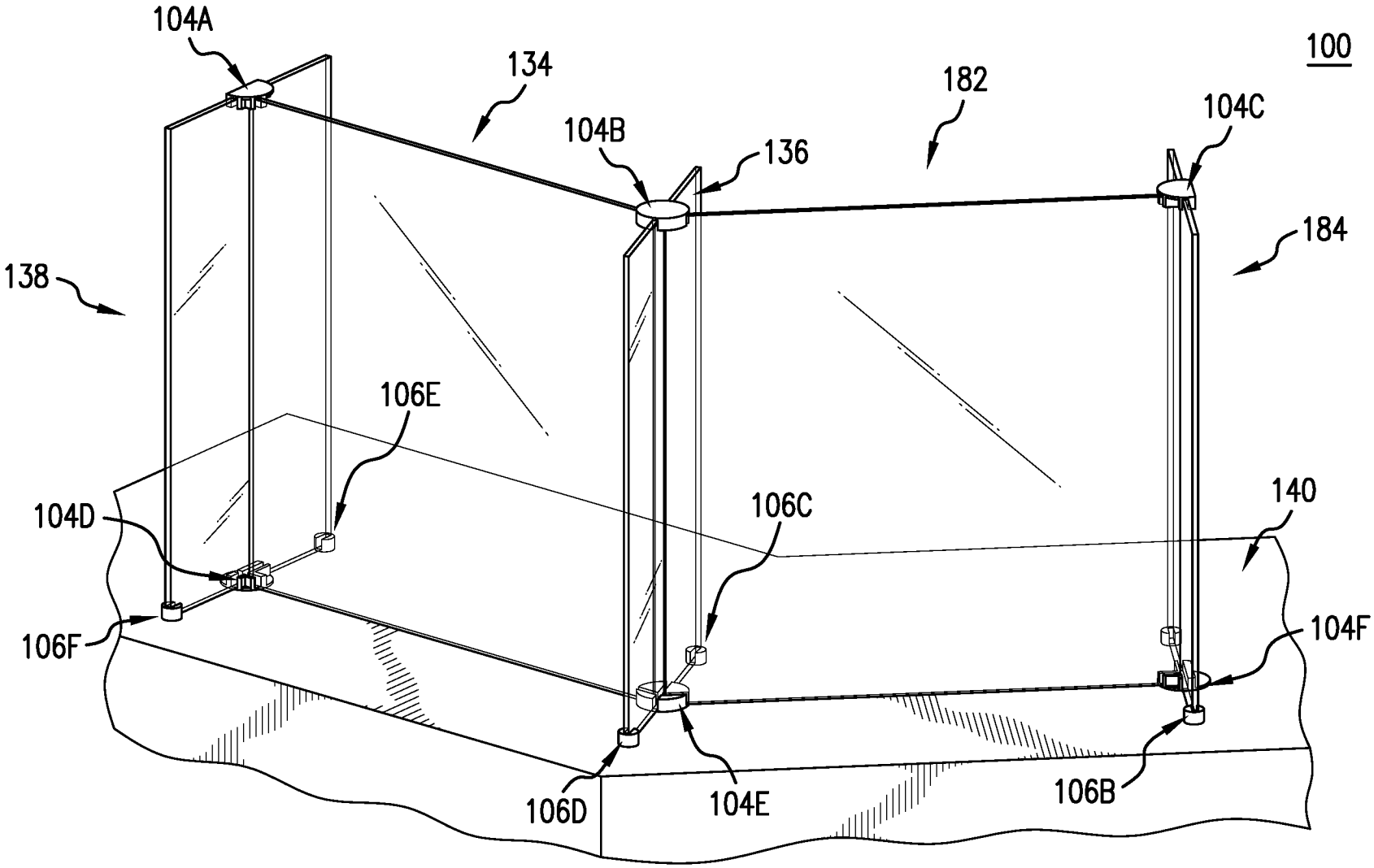
FIG. 12 depicts a schematic diagram of a third embodiment of a barrier system, according to at least some embodiments disclosed herein.

A third embodiment of the barrier system 100 is depicted in FIG. 12. The third embodiment of the barrier system 100 is substantially similar to the second embodiment of the barrier system 100. However, in the third embodiment of the barrier system 100, the first floating barrier element 134 and the fourth floating barrier element 182 are at an acute angle in relation to the second floating barrier element 136.

Figure 13:
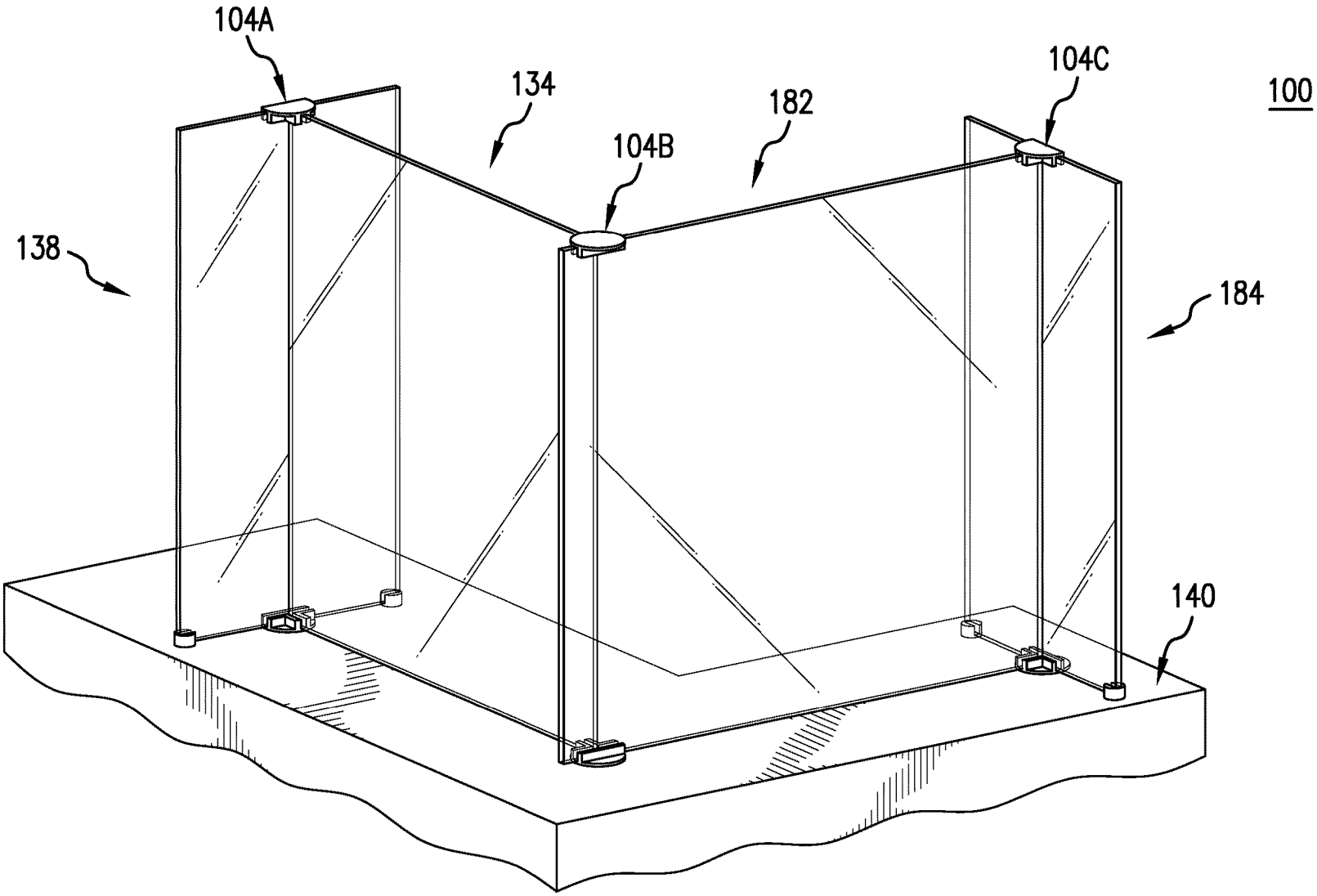
FIG. 13 depicts a schematic diagram of a fourth embodiment of a barrier system, according to at least some embodiments disclosed herein.

A fourth embodiment of the barrier system 100 is depicted in FIG. 13. The fourth embodiment of the barrier system 100 is substantially similar to other embodiments of the barrier system 100. However, the fourth embodiment of the barrier system 100 includes the first floating barrier element 134, the third floating barrier element 138, the fourth floating barrier element 182, and the fifth floating barrier element 184. The first floating barrier element 134 is at an angular orientation to the fourth floating barrier element 182. In some examples, the angle is a 90 degree angle. However, the angular orientation is not limited to such. Further, the fifth floating barrier element 184 is perpendicular to the fourth floating barrier element 182. Also, the third floating barrier element 138 is perpendicular to the first floating barrier element 134.

Figure 14:
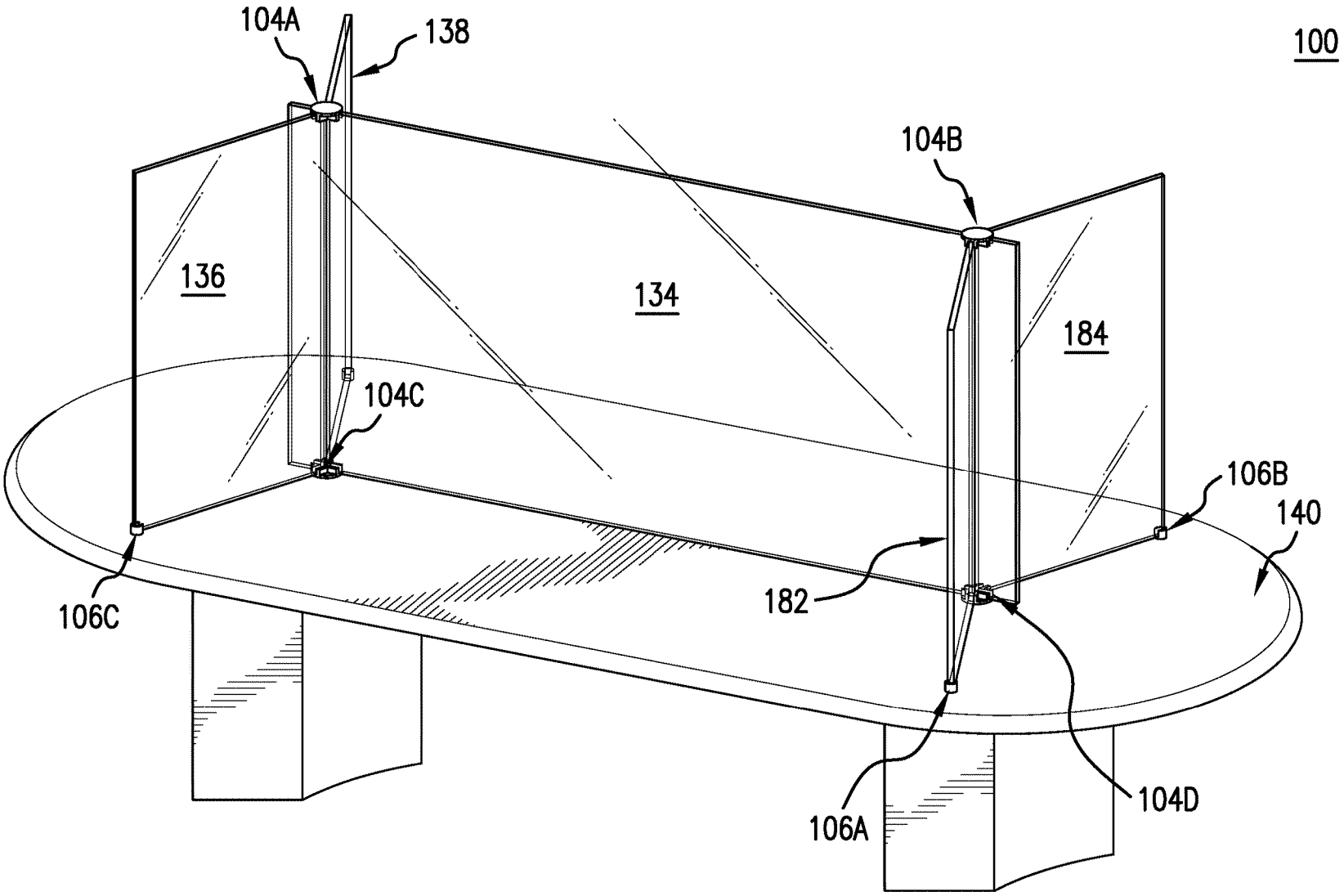
FIG. 14 depicts a schematic diagram of a fifth embodiment of a barrier system, according to at least some embodiments disclosed herein.

A fifth embodiment of the barrier system 100 is depicted in FIG. 14. The fifth embodiment of the barrier system 100 is substantially similar to other embodiments of the barrier system 100. However, the fifth embodiment of the barrier system 100 includes: the first floating barrier element 134, the second floating barrier element 136, the third floating barrier element 138, the fourth floating barrier element 182, and the fifth floating barrier element 184. The first floating barrier element 134 is disposed between the second floating barrier element 136 and the third floating barrier element 138 at one end (e.g., a first end) of the first floating barrier element 134 and the fourth floating barrier element 182 and the fifth floating barrier element 184 at another end (e.g., a second end) of the first floating barrier element 134. The first end is disposed opposite the second end.

In this embodiment, the second floating barrier element 136 and the third floating barrier element 138 are at an acute angle in relation to the first floating barrier element 134. Further, the fourth floating barrier element 182 and the fifth floating barrier element 184 are at an acute angle in relation to the first floating barrier element 134.

Figure 15:
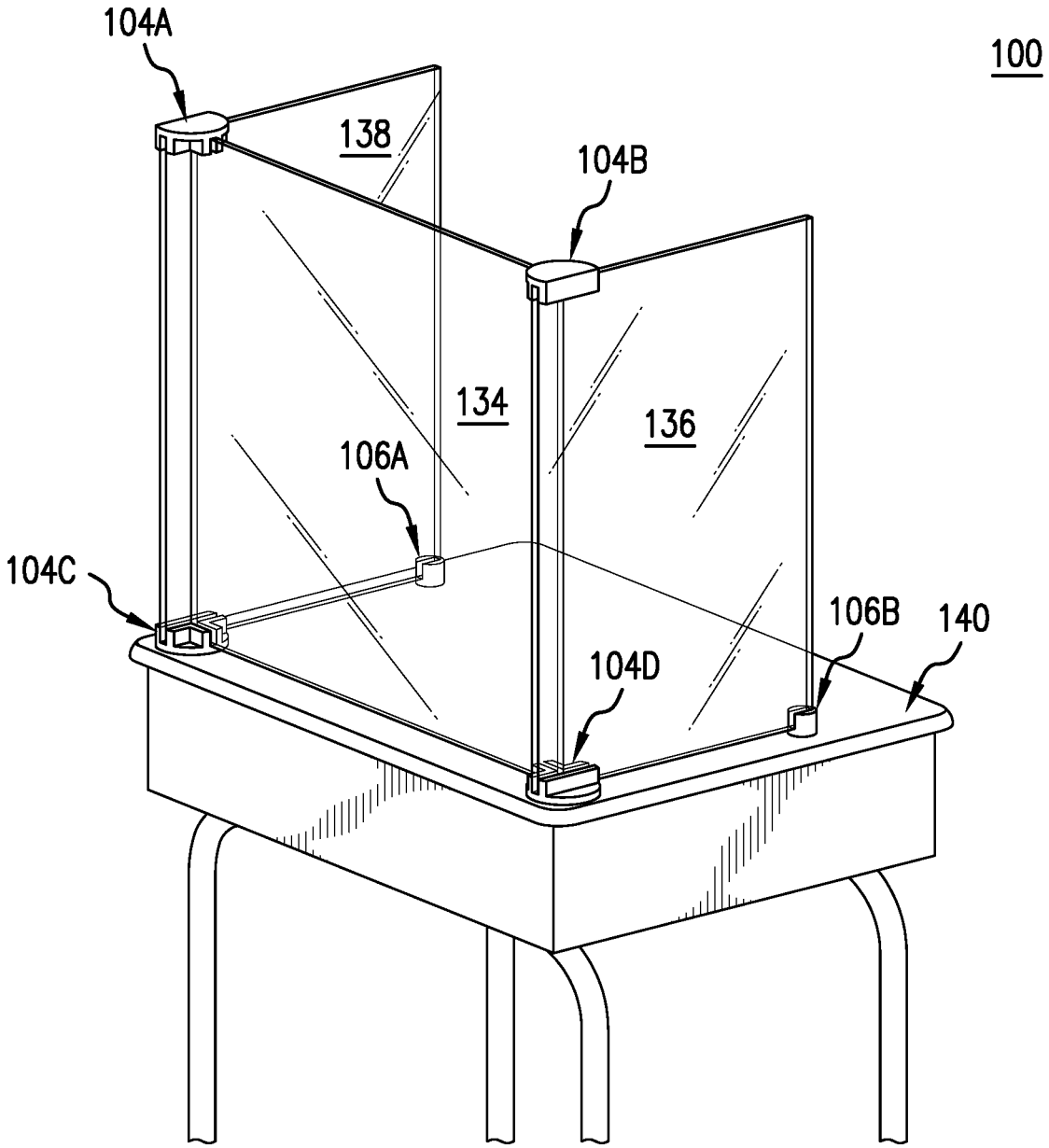
FIG. 15 depicts a schematic diagram of a sixth embodiment of a barrier system, according to at least some embodiments disclosed herein.

A sixth embodiment of the barrier system 100 is depicted in FIG. 15. The sixth embodiment of the barrier system 100 is substantially similar to other embodiments of the barrier system 100. However, in the sixth embodiment of the barrier system 100, the first floating barrier element 134 is disposed between the second floating barrier element 136 and the third floating barrier element 138. The second floating barrier element 136 and the third floating barrier element 138 are each perpendicular to the first floating barrier element 134. As depicted in FIG. 15, the horizontal surface 140 may be a surface of a desk, among others.

Each of the at least three floating barrier elements 134, 136, and 138 may comprise a material, such as a glass material or a plastic material, among other materials not explicitly listed herein. The glass material is scratch resistant, easy to clean, and sturdy. In another embodiment, each of the at least three floating barrier elements 134, 136, and 138 has a width of ¼ inch and comprises a clear, transparent glass material, where the glass may be an annealed glass, a heath strengthened glass, or a fully tempered glass, among others not explicitly listed herein. It should be appreciated that the material comprising each of the at least three floating barrier elements 134, 136, and 138 is not limited to the materials described herein, as such materials are provided for illustrative purposes only. Furthermore, similar to the size of each of the at least four securement components 104A, 104B, 104C, and 104D and the size of each of the at least four stabilizing components 106A, 106B, 106C, and 106D, a size of each of the at least three floating barrier elements 134, 136, and 138 may be increased or decreased depending on the needs of the user.

A modulus of rupture (MOR), as described herein, refers to a material's ability to resist deformation under load for short load durations of under one minute for undamaged glass in a four-sided support. An average MOR of the annealed glass is 6,000 psi (or 41 MPa), an average MOR for the heath strengthened glass is 12,000 psi (or 83 MPa), and an average MOR for the fully tempered glass is 24,000 psi (or 166 MPa). A probability of breakage for the surface of the annealed glass is 2,8000 psi (or 19 MPa), a probability of breakage for the surface of the heath strengthened glass is 5,600 psi (or 39 MPa), and a probability of breakage for the surface of the fully tempered glass is 11,200 psi (or 77 MPa). See, "The standard specification for the heat-strengthened and fully tempered flat glass," ASTM International, Designation: C1048-18, 2019, the contents of which are hereby fully incorporated by reference in their entirety.

It should further be appreciated that each of at least four securement components 104A, 104B, 104C, and 104D and each of the at least four stabilizing components 106A, 106B, 106C, and 106D may comprise a resin material, a plastic material, a three-dimensional (3D) printed material, or a rubber material, among other materials not explicitly listed herein. These materials are provided for illustrative purposes only.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A barrier system comprising:

at least three floating barrier elements, wherein each of the at least three floating barrier elements comprise:

a first surface disposed opposite a second surface;

a first side disposed opposite a second side; and a third side disposed opposite a fourth side;

wherein a first floating barrier element of the at least three floating barrier elements is affixed between a second floating barrier element of the at least three floating barrier elements and a third floating barrier element of the at least three floating barrier elements such that the third side of the first floating barrier element is perpendicular to the first surface of the second floating barrier element and the fourth side of the first floating barrier element is perpendicular to the first surface of the third floating barrier element;

at least four securement components configured to secure the first floating barrier element between the second floating barrier element and the third floating barrier element to form a barrier;

at least four stabilizing components configured to stabilize the barrier;

wherein each of the at least four securement components comprises:

a body disposed between a first planar side and a second side, the second side comprising at least two receiving components extending away from the second side;

wherein each of the at least two receiving components comprise two parallel components forming a channel therebetween;

wherein a portion of at least one of the two parallel components comprises an opening configured to receive a fastening component therethrough; and wherein a second receiving component of the at least two receiving components and a third receiving component of the at least two receiving components are at an angle in relation to a first receiving component of the at least two receiving components.

2. The system of claim 1, wherein a quantity of the at least two receiving components is three; and wherein the first receiving component of the at least two receiving components spans a length of the second side of at least one of the first, second, and third floating barrier elements.

3. The system of claim 2, wherein the second receiving component of the at least two receiving components and the third receiving component of the at least two receiving components are perpendicular to the first receiving component of the at least two receiving components; and further comprising a channel of the first receiving component fails to intersect with a channel of the second receiving component or a channel of the third receiving component.

4. The system of claim 1, wherein a quantity of the at least three floating barrier elements is five;

wherein the second floating barrier element, the third floating barrier element, a fourth floating barrier element, and a fifth floating barrier element of the at least three floating barrier elements share a shape and a size; and wherein the shape and the size of the second floating barrier element, the third floating barrier element, the fourth floating barrier element, and the fifth floating barrier element differs from the shape and the size of the first floating barrier element of the at least three floating barrier elements.

5. A method to create a barrier, the method comprising:

placing a first floating barrier element between at least a second floating barrier element and a third floating barrier element;

securing the first floating barrier element to the second floating barrier element via at least two securement components;

securing the first floating barrier element to the third floating barrier element via the at least two securement components to form the barrier;

utilizing at least four stabilizing components to stabilize the barrier;

placing the first floating barrier element between a fourth floating barrier element and a fifth floating barrier element, wherein the second floating barrier element, the third floating barrier element, the fourth floating barrier element, and the fifth floating barrier element are positioned at an angle relative to the first floating barrier element; and wherein the angle is an acute angle.

6. The method of claim 5, wherein the first floating barrier element is perpendicular to the second floating barrier element and is perpendicular to the third floating barrier element.

7. A barrier system comprising:

at least three floating barrier elements, wherein each of the at least three floating barrier elements comprise:

a first surface disposed opposite a second surface;

a first side disposed opposite a second side; and a third side disposed opposite a fourth side;

wherein a first floating barrier element of the at least three floating barrier elements is affixed between a second floating barrier element of the at least three floating barrier elements and a third floating barrier element of the at least three floating barrier elements such that the third side of the first floating barrier element is perpendicular to the first surface of the second floating barrier element and the fourth side of the first floating barrier element is perpendicular to the first surface of the third floating barrier element;

at least four securement components configured to secure the first floating barrier element between the second floating barrier element and the third floating barrier element to form a barrier;

at least four stabilizing components configured to stabilize the barrier;

wherein each of the at least four securement components comprises:

a body disposed between a first planar side and a second side, the second side comprising at least two receiving components extending away from the second side;

wherein each of the at least two receiving components comprise two parallel components forming a channel therebetween; and wherein a portion of at least one of the two parallel components comprises an opening configured to receive a fastening component therethrough;

wherein a quantity of the at least two receiving components is three;

wherein a first receiving component of the at least two receiving components spans a length of the second side of at least one of the first, second, and third floating barrier elements;

wherein a second receiving component of the at least two receiving components and a third receiving component of the at least two receiving components are perpendicular to the first receiving component of the at least two receiving components; and further comprising a channel of the first receiving component fails to intersect with a channel of the second receiving component or a channel of the third receiving component.

8. The system of claim 7, wherein the second receiving component of the at least two receiving components and the third receiving component of the at least two receiving components are at an angle in relation to the first receiving component of the at least two receiving components.

9. The system of claim 7, wherein a quantity of the at least three floating barrier elements is five;

wherein the second floating barrier element, the third floating barrier element, a fourth floating barrier element, and a fifth floating barrier element of the at least three floating barrier elements share a shape and a size; and wherein the shape and the size of the second floating barrier element, the third floating barrier element, the fourth floating barrier element, and the fifth floating barrier element differs from the shape and the size of the first floating barrier element of the at least three floating barrier elements.

* * * * *